US009599416B2

(12) United States Patent
Slocum

(10) Patent No.: US 9,599,416 B2
(45) Date of Patent: Mar. 21, 2017

(54) DEVICE TO AID IN LOADING CARTRIDGES INTO A PISTOL MAGAZINE

(71) Applicant: John Peyton Slocum, Woodruff, SC (US)

(72) Inventor: John Peyton Slocum, Woodruff, SC (US)

( * ) Notice: Subject to any disclaimer, the term of this patent is extended or adjusted under 35 U.S.C. 154(b) by 0 days.

(21) Appl. No.: 14/793,935

(22) Filed: Jul. 8, 2015

(65) Prior Publication Data

US 2016/0025437 A1 Jan. 28, 2016

Related U.S. Application Data

(60) Provisional application No. 62/029,442, filed on Jul. 26, 2014.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/84
USPC ..... 42/87, 88
See application file for complete search history.

(56) References Cited

U.S. PATENT DOCUMENTS 4,689,909 A * 9/1987 Howard ..... F41A 9/83 42/87
4,827,651 A * 5/1989 Conkey ..... F41A 9/83 42/87
4,993,180 A * 2/1991 Upchurch ..... F41A 9/83 42/87
5,355,606 A * 10/1994 Origoni ..... F41A 9/83 42/87
5,377,436 A 1/1995 Switzer
6,189,254 B1 2/2001 Steitz
6,286,243 B1 9/2001 Hinton
6,817,134 B2 11/2004 Newman
7,257,919 B1 8/2007 Farley
7,487,613 B2 2/2009 Taylor
7,637,048 B2 12/2009 Tal et al.
8,065,830 B2 11/2011 Twardy
8,356,441 B2 1/2013 Meinel
9,347,722 B1 * 5/2016 Morris ..... F41A 9/83
2013/0061505 A1 * 3/2013 Faifer ..... F41A 9/83 42/87

* cited by examiner

*Primary Examiner* — Stephen M Johnson
(74) *Attorney, Agent, or Firm* — J. Bennett Mullinax, LLC

(57) ABSTRACT

A device to aid in loading cartridges into a pistol magazine, comprised of an upper section having a top surface for applying downward force with the user's thumb and a roughly rectangular lower section for contact with the cartridges within the magazine. The rectangular lower section is divided into a forward "pushing" section and a rearward "retaining" section by a slot which slidingly engages the rear wall of the magazine, thus providing stability and requiring only downward force to operate. The device is fitted with a hole through the upper section through which a cord, cable, or chain may be affixed, allowing the device to be conveniently carried on a key ring or on an attachment point on a gear bag.

15 Claims, 3 Drawing Sheets

DEVICE TO AID IN LOADING CARTRIDGES INTO A PISTOL MAGAZINE

CROSS-REFERENCE TO RELATED APPLICATIONS

This application claims priority from U.S. Provisional Patent Application Ser. No. 62/029,442 filed on Jul. 26, 2014, the disclosure of which is incorporated herein.

STATEMENT REGARDING FEDERALLY SPONSORED RESEARCH OR DEVELOPMENT

Not Applicable

BACKGROUND OF THE INVENTION

This invention relates to firearms and, more particularly, to a device used to aid in loading pistol magazines.

In general, the difficulties in manually loading cartridges into a pistol magazine are well known. Pistol magazines are generally in the form of a rectangular tube made of steel or aluminum. The magazine is closed on the bottom, front, back, and sides. The top is open, for the insertion of cartridges and subsequent dispensing of cartridges into the pistol. At the top, the sides of the magazine curve inward slightly to form lips for the retention of the cartridges. Pistol magazines are commonly manufactured in two configurations, referred to as single-stack and double-stack. Single-stack magazines are those in which the cartridges are stacked directly on top of one another, with the longitudinal axis of each cartridge coplanar with all the other cartridges. Double-stack magazines are those in which the cartridges are staggered within the magazine, allowing for a greater number of cartridges within the length of the magazine. Due to the range of diameters and lengths of pistol cartridges, along with the availability of magazines in both single- and double-stack configuration, there currently exists a large number of variations in the cross-sectional area of pistol magazines.

Inside each magazine is a follower plate, upon which the first loaded cartridge rests, and below the follower plate a spring which provides constant upward pressure on the cartridges. The stiffness of the spring makes the loading of cartridges difficult, with the force necessary to compress the spring increasing as each subsequent cartridge is loaded. Not only is manual loading time-consuming and difficult, but some magazines can be nearly impossible to load to full capacity when new, as the magazine spring has not relaxed from repeated use. Users also risk injury to the fingers or thumbs due to the potentially sharp edges of the metal magazine. Improper loading of the magazine can also lead to jamming of the cartridges within the magazine. As a result, many devices for loading cartridges into pistol magazines have been proposed in past years.

Numerous complex devices have been proposed to aid in loading cartridges into pistol magazines. Examples of complex devices are disclosed in Tal, et al U.S. Pat. No. 7,637,048, Switzer U.S. Pat. No. 5,377,436, Newman U.S. Pat. No. 6,817,134, and Meinel U.S. Pat. No. 8,356,441. While at least one of these has been commercialized, with apparent success in the marketplace, these devices may be considered undesirably complex. The complexity, with many moving parts, can result in high manufacturing costs and potential mechanical failure after a period of use. The size of these devices can make them undesirable for field use due to the space they would occupy in an accessory bag or pistol case. In addition, the device disclosed in the Tal patent requires a table or flat surface upon which to rest and stabilize the magazine while using the device. Such surfaces are not always available at outdoor shooting ranges or in the field.

Many simple devices to aid in loading pistol magazines have been proposed. Examples of one type of simple device are disclosed in Conkey U.S. Pat. No. 4,827,651, Upchurch U.S. Pat. No. 4,993,180, Hinton U.S. Pat. No. 6,286,243, and Farley U.S. Pat. No. 7,257,919. Devices as in these disclosures have also been commercialized. These devices, while helpful, present a problem when magazines of different sizes are encountered. Since these devices are designed to fit around the outside of a magazine, numerous sizes must be made available to users. A device designed for use with a narrow single-stack magazine will not fit around a wider double-stack magazine. Likewise, a device designed to fit around a larger caliber double-stack magazine will be a loose and inefficient fit on a smaller caliber single-stack magazine. Thus, there is a need for a simple device which can be used on a greater range of magazine sizes.

Further simple devices have been disclosed in Steitz U.S. Pat. No. 6,189,254, Taylor U.S. Pat. No. 7,487,613, and Twardy U.S. Pat. No. 8,065,830. These devices answer the problems of complexity and size noted in the previously mentioned disclosures. In addition, these devices do not require indexing or fitting on the outside dimensions of a magazine and are thus suited for use with a greater range of magazine sizes. While helpful, these devices present a problem of stability and dexterity when used. The casing of pistol cartridges is typically made of brass or steel, resulting in a slick surface. The use of these devices requires not only downward force from the user's thumb but also lateral force to stabilize the device and to prevent the device from slipping on the cartridge casing. If the portion of the device used to contact and apply downward force to the cartridge casing slides forward along the cartridge casing during use it becomes difficult or impossible to insert the next cartridge under the magazine lips. There is, thus, a need for a device to aid in loading pistol magazines which is simple, compact, versatile, and self-stabilizing when used.

BRIEF SUMMARY OF THE INVENTION

The principal object of the current invention is to provide a simple and compact device to aid in loading cartridges into a pistol magazine. While many previous inventions are complex or bulky, the current invention has no moving parts and is small enough to be conveniently carried on a key ring or lanyard. The invention described herein is designed to be self-stabilizing during use by means of indexing on the rear wall of the magazine. This self-stabilizing feature prevents the invention from slipping or sliding on the surface of the cartridge case during use, where such slipping or sliding would make it difficult or impossible to load the next cartridge into the magazine. A further benefit of the invention is that it can be used to load virtually any type or size of pistol magazine designed for use with ammunition calibers of about .380 caliber to about .45 caliber.

DETAILED DESCRIPTION AND BEST MODE OF IMPLEMENTATION

Figure 1:
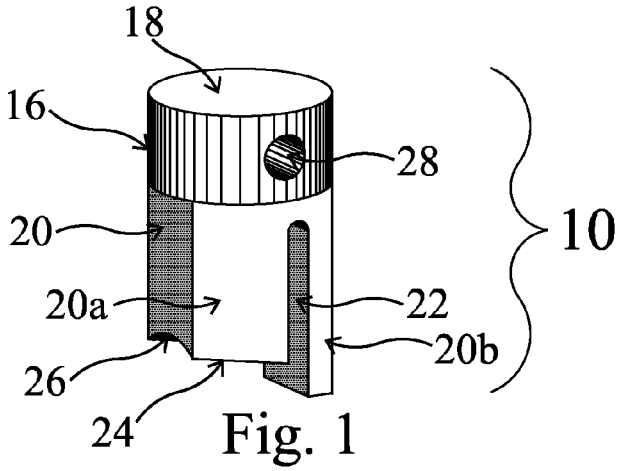
FIG. 1 is a perspective view of the device.
Figure 2:
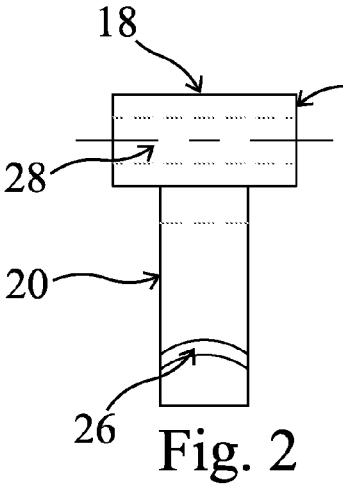
FIG. 2 is a front elevational view of the device.
Figure 3:
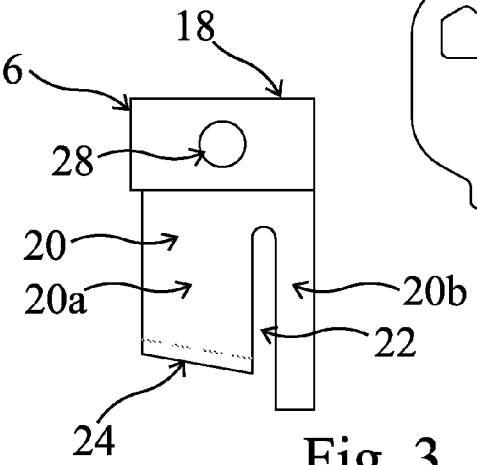
FIG. 3 is a side elevational view of the device showing size in proportion to a typical house key.
Figure 2A:
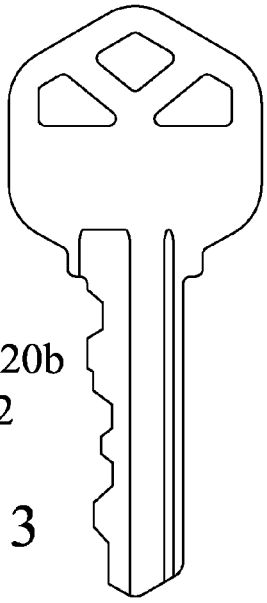
FIG. 2*a* is a front elevational view of the device showing the location of one critical dimension.
Figure 2A:
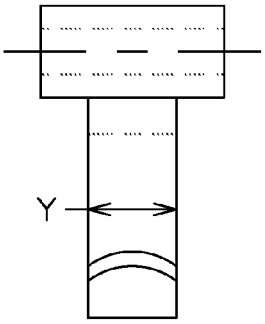
Figure 3A:
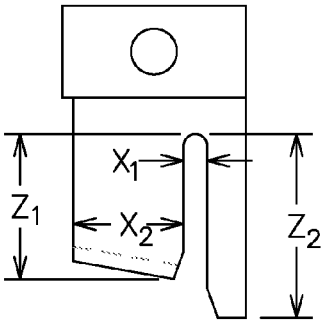
FIG. 3*a* is a side elevational view of the device showing the locations of other critical dimensions and also showing an improvement to the design, having angled surfaces on the rear of the "pushing" section and on the front of the "retaining" section.

Referring now to the Figures, a device 10 is shown to aid in manually loading cartridges 12 into a pistol magazine 14. Device 10 is comprised of an upper body 16 with a flat top surface 18 and integrally associated with a roughly rectangular lower section 20. The rectangular lower section 20 is divided into a forward "pushing" section 20*a* and a rearward "retaining" section 20*b* by a slot 22 which extends upward from the bottom of the device to a point near the intersection of the upper body 16 and the rectangular lower section 20. The length of the slot 22 is designed such that the forward "pushing" section 20*a* has a length slightly greater than the diameter of the cartridge 12 body. The width of the slot 22 is advantageously designed to slidingly engage the rear wall 30 of the pistol magazine 14. The bottom of the forward "pushing" section 20*a* is angled 24 to correspond to the typical angle of the cartridges 12 in the magazine 14. It is also advantageously supplied with a concave surface 26 to provide a stable engagement with the rounded surface of the cartridge 12 body. The device 10 is also supplied with a hole 28 strategically placed in the upper body 16 and through which a cord, chain, or cable can be affixed and thus allow for the device 10 to be conveniently carried on a key ring.

An apparatus 10 to load cartridges 12 into a pistol magazine 14 has a body having an upper surface, a lower surface, a first side wall, a second side wall, a front, a back, and defining a vertical axis, wherein a lower portion of the body defines a rectangular cross section and upper portion of the body is cylindrical; a slot defined within the body and having a vertical axis parallel to the vertical axis of the body, the slot positioned between the front and the back and thereby defining a pushing section between the slot and the front and further defining a retaining section between the slot and the back, the slot extending through the lower surface and the slot further defining a first slot wall surface in proximity to the lower surface of the pushing section, the first slot wall surface tapering in a direction away from the slot vertical axis, and the slot further defining a second slot wall surface in proximity to the lower surface of the retaining section and tapering in a direction away from the slot vertical axis, the retaining section having a height greater than a height of the pushing section; an arcuate edge defined along the lower surface of the pushing section, the arcuate edge adapted for securing a cylindrical portion of a cartridge, the lower surface of the pushing section having an included angle less than 90 degrees relative to the vertical axis.

Figure 4:
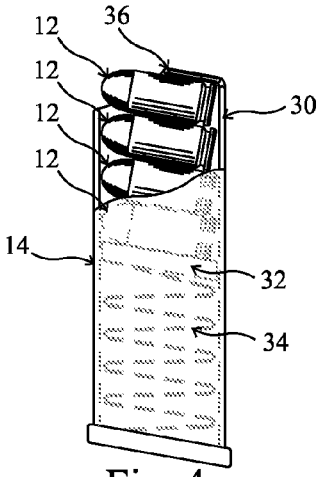
FIG. 4 shows a partially loaded pistol magazine.
Figure 5:
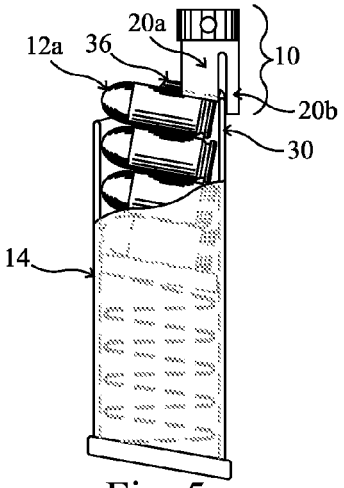
FIG. 5 shows the device placed on the uppermost cartridge and ready for use.
Figure 6:
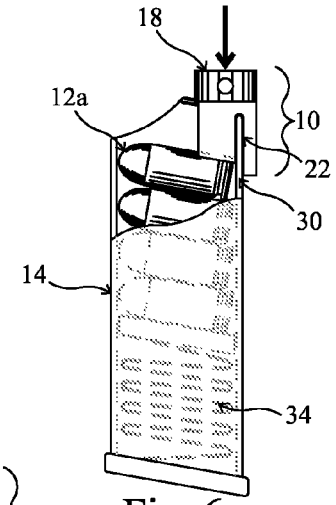
FIG. 6 shows the device in use—pushing the cartridges down in preparation for loading the next cartridge.
Figure 7:
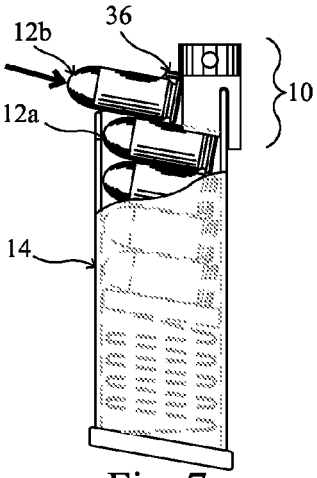
FIG. 7 shows the device in full downward position and a cartridge being inserted.
Figure 8:
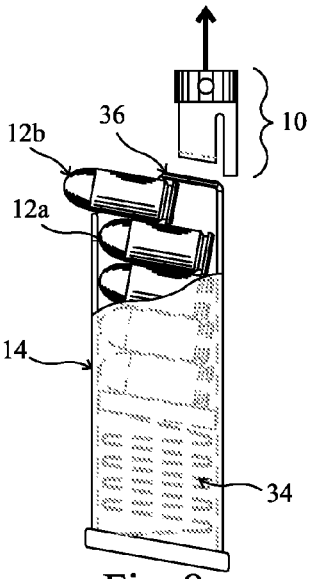
FIG. 8 shows the device being removed from the magazine.
Figure 9:
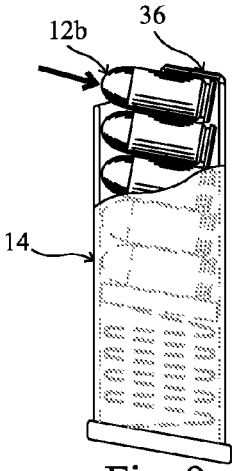
FIG. 9 shows the cartridge being fully inserted.
Figure 10:
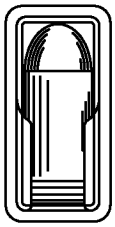
Fig. 10 (Prior Art)
FIG. 10 is a top view of a typical small caliber single-stack magazine.
Figure 11:
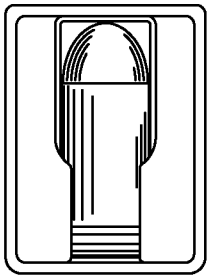
Fig. 11 (Prior Art)
FIG. 11 is a top view of a typical large caliber double-stack magazine.
Figure 12:
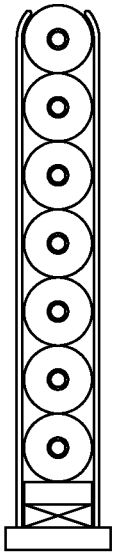
Fig. 12 (Prior Art)
FIG. 12 is a rear sectional view of a typical small caliber single-stack magazine.
Figure 13:
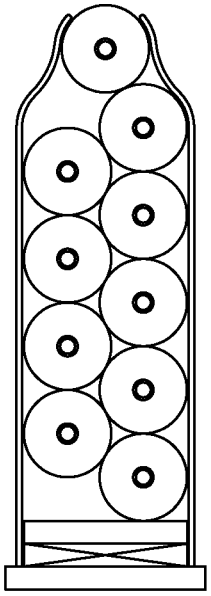
Fig. 13 (Prior Art)
FIG. 13 is a rear sectional view of a typical large caliber double-stack magazine.

Referring now to FIGS. 4 through 9, the operation and usage of the device 10 is represented. As represented in FIG. 4, it is advantageous to have one or more cartridges 12 loaded into the magazine 14 prior to using the device 10. Manually loading the first cartridge 12 is generally a simple task as it insures correct placement of the cartridge against the follower plate 32 and only a small force is necessary to overcome the upward force of the spring 34. In FIG. 5 the device 10 has been placed against the uppermost cartridge 12*a* with the forward "pushing" section 20*a* positioned between the magazine lips 36 (only one shown) and the rearward "retaining" section 20*b* positioned outside the rear wall 30 of the magazine 14. In FIG. 6 the device 10 has been pushed down, thus compressing the spring 34 and moving the existing cartridge(s) 12 downward in the magazine 14. In normal usage, the magazine 14 would be grasped in the user's hand, with the thumb of the same hand used to apply downward force to the flat top surface 18 of the device 10. At this point the slot 22 of the device 10 has slidingly engaged the rear wall 30 of the magazine 14, thus stabilizing the device 10 to prevent sliding on the cartridge 12*a*. Referring to FIG. 7, while holding the device 10 in place a new cartridge 12*b* is inserted into the magazine 14 such that the base of the cartridge 12*b* contacts the device 10 under the magazine lips 36 (only one shown). As shown in FIG. 8, the device 10 is removed from the magazine 14, allowing the spring 34 to supply upward force, capturing the new cartridge 12*b* between the previous cartridge 12*a* and the magazine lips 36. In FIG. 9 the new cartridge 12*b* is easily slid into place under the lips 36 of the magazine 14. The operations described in FIGS. 5 through 9 may be repeated until the magazine 14 is full.

The device 10 may be manufactured using any manufacturing operation capable of producing the geometry as specified in the figures. As for materials, the device 10 may be manufactured from any material having the rigidity to overcome the force of the magazine spring 34. By way of example, the device 10 may be machined from any of a variety of ferrous or non-ferrous metals or from any plastic or polymer material capable of being machined to the geometry specified in the figures. It may also be molded by casting or injection molding using any suitable plastic or polymer material including, but not limited to, epoxy, polyester, polyurethane, nylon, acetal, or ABS resins.

While the foregoing detailed description has set forth a preferred embodiment of the invention, it will be appreciated by those skilled in the art that modifications may be made thereto. Accordingly, it is to be understood that the scope of the invention should be determined, not by the preceding embodiment, but by the scope of the following claims.

What is claimed is:

1. An apparatus to load cartridges into a pistol magazine comprising;

a body having an upper surface, a lower surface, a first side wall, a second side wall, a front, a back, and defining a vertical axis, wherein a lower portion of the body defines a rectangular cross section;

a slot defined within the body and having a vertical axis parallel to the vertical axis of the body, the slot positioned between the front and the back and thereby defining a pushing section between the slot and the front and further defining a retaining section between the slot and the back, the slot extending through the lower surface and the slot further defining a first slot wall surface in proximity to the lower surface of the pushing section, the first slot wall surface tapering in a direction away from the slot vertical axis, and the slot further defining a second slot wall surface in proximity to the lower surface of the retaining section and tapering in a direction away from the slot vertical axis, the retaining section having a height greater than a height of the pushing section;

an arcuate edge defined along the lower surface of the pushing section, the arcuate edge adapted for securing a cylindrical portion of a cartridge, the lower surface of the pushing section having an included angle less than 90 degrees relative to the vertical axis.

2. The apparatus according to claim 1 wherein, said body further defines an aperture there through and adapted for placement of an attachment device therein.

3. The apparatus according to claim 1 wherein the upper surface of the body is adapted for engagement by a downward force applied with a user's thumb or finger.

4. The apparatus according to claim 1 wherein the slot defined within the body has a width adapted to allow the slot to slidingly engage a rear wall of a pistol magazine.

5. The apparatus according to claim 1 wherein the pushing section has a height greater than a diameter of a cartridge being loaded into a magazine.

6. The apparatus according to claim 1 wherein an upper portion of the body is cylindrical.

7. The apparatus according to claim 1 wherein the arcuate edge connects the first side wall and the second side wall, the first and the second side walls being parallel.

8. An apparatus to load cartridges into a pistol magazine comprising;

a body having an upper surface, a lower surface, a first side wall, a second side wall, a front, a back, and defining a vertical axis wherein an upper portion of the body is cylindrical;

a slot defined within the body and having a vertical axis parallel to the vertical axis of the body, the slot positioned between the front and the back and thereby defining a pushing section between the slot and the front and further defining a retaining section between the slot and the back, the slot extending through the lower surface and the slot further defining a first slot wall surface in proximity to the lower surface of the pushing section, the first slot wall surface tapering in a direction away from the slot vertical axis, and the slot further defining a second slot wall surface in proximity to the lower surface of the retaining section and tapering in a direction away from the slot vertical axis, the retaining section having a height greater than a height of the pushing section;

an arcuate edge defined along the lower surface of the pushing section, the arcuate edge adapted for securing a cylindrical portion of a cartridge, the lower surface of the pushing section having an included angle less than 90 degrees relative to the vertical axis.

9. The apparatus according to claim 8 wherein a lower portion of the body defines a rectangular cross section.

10. The apparatus according to claim 8 wherein, said body further defines an aperture there through and adapted for placement of an attachment device therein.

11. The apparatus according to claim 8 wherein the upper surface of the body is adapted for engagement by a downward force applied with a user's thumb or finger.

12. The apparatus according to claim 8 wherein the slot defined within the body has a width adapted to allow the slot to slidingly engage a rear wall of a pistol magazine.

13. The apparatus according to claim 8 wherein the pushing section has a height greater than a diameter of a cartridge being loaded into a magazine.

14. The apparatus according to claim 8 wherein the arcuate edge connects the first side wall and the second side wall, the first and the second side walls being parallel.

15. An apparatus to load cartridges into a pistol magazine comprising;

a body having an upper surface, a lower surface, a first side wall, a second side wall, a front, a back, and defining a vertical axis, wherein a lower portion of the body defines a rectangular cross section and upper portion of the body is cylindrical;

a slot defined within the body and having a vertical axis parallel to the vertical axis of the body, the slot positioned between the front and the back and thereby defining a pushing section between the slot and the front and further defining a retaining section between the slot and the back, the slot extending through the lower surface and the slot further defining a first slot wall surface in proximity to the lower surface of the pushing section, the first slot wall surface tapering in a direction away from the slot vertical axis, and the slot further defining a second slot wall surface in proximity to the lower surface of the retaining section and tapering in a direction away from the slot vertical axis, the retaining section having a height greater than a height of the pushing section;

an arcuate edge defined along the lower surface of the pushing section, the arcuate edge adapted for securing a cylindrical portion of a cartridge, the lower surface of the pushing section having an included angle less than 90 degrees relative to the vertical axis.

* * * * *